US007919342B2

(12) United States Patent
Cok

(10) Patent No.: US 7,919,342 B2
(45) Date of Patent: Apr. 5, 2011

(54) PATTERNED INORGANIC LED DEVICE

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 195 days.

(21) Appl. No.: 12/266,775

(22) Filed: Nov. 7, 2008

(65) Prior Publication Data

US 2009/0068918 A1 Mar. 12, 2009

Related U.S. Application Data

(62) Division of application No. 11/681,920, filed on Mar. 5, 2007, now abandoned.

(51) Int. Cl.
*H01J 9/12* (2006.01)

(52) U.S. Cl. ..... 438/42; 438/22; 438/26; 438/27; 438/29; 257/79

(58) Field of Classification Search ..... 313/503, 313/504, 506; 257/79, 88, 89, 93, 98, 99; 438/22, 26, 27, 29, 42, 46
See application file for complete search history.

(56) References Cited

U.S. PATENT DOCUMENTS

| | | | | |
|---|---|---|---|---|
| 6,281,634 | B1 | 8/2001 | Yokoyama | |
| 6,797,412 | B1 | 9/2004 | Jain et al. | |
| 6,900,470 | B2 | 5/2005 | Kobayashi et al. | |
| 2001/0026124 | A1 | 10/2001 | Liu | |
| 2002/0011783 | A1 | 1/2002 | Hosokawa | |
| 2002/0158835 | A1 | 10/2002 | Kobayashi et al. | |
| 2003/0042472 | A1 | 3/2003 | Fujita et al. | |
| 2004/0253756 | A1 | 12/2004 | Cok et al. | |
| 2005/0072971 | A1 | 4/2005 | Marrocco, III et al. | |
| 2005/0230673 | A1 | 10/2005 | Mueller et al. | |
| 2006/0220543 | A1* | 10/2006 | Makiura | 313/506 |
| 2007/0001581 | A1 | 1/2007 | Stasiak et al. | |
| 2007/0057263 | A1 | 3/2007 | Kahen | |
| 2007/0102694 | A1* | 5/2007 | Drndic et al. | 257/14 |
| 2008/0057209 | A1* | 3/2008 | Warren et al. | 427/422 |

FOREIGN PATENT DOCUMENTS

| | | |
|---|---|---|
| EP | 0 880 303 | 11/1998 |
| EP | 1 577 957 | 9/2005 |
| WO | 02/37580 | 5/2002 |
| WO | 2005/055330 | 6/2005 |

OTHER PUBLICATIONS

Hikmet et al., "Study of Conduction Mechanism and Electroluminescence in CdSe/ZnS Quantum Dot Composites", Journal of Applied Physics, 93, pp. 3509-3514, 2003.

Coe et al., "Electroluminescence from signle monolyers of nanocrystals in molecular organic devices," Nature vol. 420, pp. 800-803, 2002.

Mueller et al., "Multicolor Light-Emitting Diodes Based on Seminconductor Nanocrystals Encapsulated in GaN Charge Injection Layers," Nano Letters, vol. 5, No. 6, pp. 1039-1044, 2005.

* cited by examiner

*Primary Examiner* — David Vu
*Assistant Examiner* — Suberr Chi
(74) *Attorney, Agent, or Firm* — Raymond L. Owens

(57) ABSTRACT

A method of making an inorganic light-emitting diode display having a plurality of light-emitting elements including providing a substrate, and forming a plurality of patterned electrodes over the substrate. A raised area is formed around each patterned electrode to provide a well before depositing a dispersion containing inorganic, light-emissive core/shell nano-particles into each well. The dispersion is dried to form a light-emitting layer including the inorganic, light-emissive core/shell nano-particles. An unpatterned, common electrode is formed over the light-emitting layer. The light-emitting layer emits light by the recombination of holes and electrons supplied by the electrodes.

14 Claims, 7 Drawing Sheets

PATTERNED INORGANIC LED DEVICE

CROSS REFERENCE TO RELATED APPLICATION

This application is a divisional of commonly assigned U.S. patent application Ser. No. 11/681,920 filed Mar. 5, 2007 now abandoned, the disclosure of which is incorporated herein.

FIELD OF THE INVENTION

The present invention relates to inorganic light emitting diode (LED) displays having a plurality of pixels, and more particularly, to inorganic displays having improved emitter patterning, light efficiency, and transparent electrode conductivity.

BACKGROUND OF THE INVENTION

Flat-panel displays, such as light emitting diode (LED) displays, of various sizes are proposed for use in many computing and communication applications. In its simplest form, an LED includes an anode for hole injection, a cathode for electron injection, and a light-emitting medium sandwiched between these electrodes to support charge recombination that yields emission of light. LED displays can be constructed to emit light through a transparent substrate (commonly referred to as a bottom-emitting display), or through a transparent top electrode on the top of the display (commonly referred to as a top-emitting display). Both organic and inorganic light-emitting materials are known and may be formed into thin-film layers.

Full-color displays employing light-emissive materials are known in the art. Typical full-color displays are constructed of three different color pixels that are red, green, and blue in color. Such an arrangement is known as an RGB design. An example of an RGB design is disclosed in U.S. Pat. No. 6,281,634. One of the main challenges of manufacturing full-color displays is the patterning of light-emissive materials. For evaporated organic materials, precision shadow mask technology is most commonly used today in manufacturing. Although shadow mask deposition of organic LED materials can work on a substrate of moderate size, e.g., 300 mm×400 mm, it becomes difficult with larger substrates or when the pixel density becomes very high, such as in top-emitting displays. One problem is the handling (fabrication, alignment, etc.) of such large, thin, and fragile shadow masks. Another problem is the thermal coefficient of expansion mismatch between the shadow mask, through which the organic LEDs are deposited, and the underlying substrate. This leads to misalignment of the mask and the proper deposition area on the substrate. Furthermore, this technique is not useful for patterning materials that are not readily evaporated.

Another challenge to top-emitting LED devices is that a transmissive top electrode is typically provided as a common electrode for many or all pixels. Unfortunately, the most effective transmissive electrode materials, e.g., ITO and other metal oxides, have insufficient conductivity across the substrate, especially for large substrates. One way to solve this problem is to introduce a highly conductive auxiliary electrode or bus. Numerous bussing designs have been proposed, e.g., in U.S. Published Patent Application Nos. 2004/0253756; 2002/0011783 and 2002/0158835, but such designs add additional complexity to the manufacturing process.

Semiconductor light-emitting diode (LED) devices, which are primarily inorganic, have been made since the early 1960's and currently are manufactured for usage in a wide range of consumer and commercial applications. The layers comprising the LEDs are based on crystalline semiconductor materials. These crystalline-based inorganic LEDs have the advantages of high brightness, long lifetimes, and good environmental stability. The crystalline semiconductor layers that provide these advantages also have a number of disadvantages. The dominant ones have high manufacturing costs; difficulty in combining multi-color output from the same chip; efficiency of light output; and the need for high-cost rigid substrates. However, in comparison to OLEDs, crystalline-based inorganic LEDs have improved brightness, longer lifetimes, and do not require expensive encapsulation for device operation.

Quantum dots are light-emitting nano-sized semiconductor crystals. Adding quantum dots to an organic emitter layer enhances the color gamut of the device; red, green, and blue emission is obtained by simply varying the quantum dot particle size; and manufacturing costs are reduced. Because of problems such as aggregation of the quantum dots in the emitter layer, the efficiency of these devices was rather low in comparison with typical OLED devices. The efficiency was even poorer when a neat film of quantum dots was used as the emitter layer (Hikmet et al., Journal of Applied Physics 93, 3509-3514 (2003)). The poor efficiency was attributed to the insulating nature of the quantum dot layer. Later the efficiency was boosted (to ~1.5 cd/A) upon depositing a monolayer film of quantum dots between organic hole and electron transport layers (Coe et al., Nature 420, 800-803 (2002)). It was stated that luminescence from the quantum dots occurred mainly as a result of Forster energy transfer from excitons on the organic molecules (electron-hole recombination occurs on the organic molecules).

Recently, a mainly all-inorganic LED was constructed (Mueller et al., Nano Letters 5, 1039-1044 (2005)) by sandwiching a monolayer thick core/shell CdSe/ZnS quantum dot layer between vacuum deposited inorganic n- and p-GaN layers. The resulting device had a poor external quantum efficiency of 0.001 to 0.01%. Part of that problem could be associated with the organic ligands of trioctylphosphine oxide (TOPO) and trioctylphosphine (TOP) that were reported to be present post growth. These organic ligands are insulators and would result in poor electron and hole injection onto the quantum dots. In addition, the remainder of the structure is costly to manufacture, due to the usage of electron and hole semiconducting layers grown by high-vacuum techniques, and the usage of sapphire substrates.

As described in co-pending, commonly assigned U.S. patent application Ser. No. 11/226,622, filed Sep. 14, 2005 by Kahen, which is hereby incorporated by reference in its entirety, additional conducting or semi-conducting particles may be provided with the quantum dots in a layer to enhance the conductivity of the light-emitting layer.

Light-emitting diode structures may be employed to form flat-panel displays. Likewise, colored-light or white-light lighting applications are of interest. Different materials may be employed to emit different colors and the materials may be patterned over a surface to form full-color pixels. In various embodiments, the quantum dot LEDs may be electronically or photonically stimulated and may be mixed or blended with a light-emitting organic host material and located between two electrodes.

A prior-art structure employing electronic stimulation uses a substrate on which is formed a first electrode, a light-emissive layer, and a second electrode. Upon the application of a current from the electrodes, electrons and holes injected into the matrix create excitors that are transferred to the quantum dots for recombination, thereby stimulating the quantum dots to produce light. Such a design is described in WO 2005/055330 A1 entitled "Electroluminescent Device." P-type and/or an n-type organic transport, charge injection, and/or charge blocking layers may be optionally employed to improve the efficiency of the device. Typically, one electrode will be reflective while the other may be transparent. No particular order is assumed for the electrodes.

A typical LED device uses a glass substrate, a transparent conducting anode such as indium-tin-oxide (ITO), a stack of charge-control and light-emitting layers, and a reflective cathode layer. Light generated from the device is emitted through the glass substrate, and thus is commonly referred to as a bottom-emitting device. Alternatively, an LED device can include a substrate, a reflective anode, a stack of charge-control and light-emitting layers, and a top transparent cathode layer. Light generated from this alternative device is emitted through the top transparent electrode, and thus is commonly referred to as a top-emitting device. In general, bottom-emitting LED devices are easier to manufacture, because the transparent electrode (e.g. ITO) employed in a top-emitting device may be difficult to deposit over the charge-control and light-emitting layers without damaging them and suffers from limited conductivity. In contrast, the evaporation of a reflective metal electrode has proved to be relatively robust and conductive. However, active-matrix bottom-emitting LED devices suffer from a reduced light-emitting area (aperture ratio), since a significant proportion (over 70%) of the substrate area can be taken up by the active-matrix components, bus lines, etc. Since some LED materials degrade in proportion to the current density passed through them, a reduced aperture ratio will increase the current density through the layers at a constant brightness, thereby significantly reducing the LED device's lifetime. Top-emitting LED devices can employ an increased aperture ratio, since light emitted from the device passes through the cover, rather than the substrate. Active-matrix devices formed on the substrate can be covered with an insulating layer and a reflective electrode formed over the active-matrix components, thereby increasing the light-emitting area. Active-matrix components, typically thin-film transistors are formed on the substrate using photolithographic processes.

Thin-film, LED devices in general suffer from a loss of light trapped in various layers of the LED, substrate, or cover, thereby decreasing the efficiency of the LED device. Typical indices of refraction for charge-control and light-emitting layers range from 1.6 to 1.7 for organic materials and well over 2.0 for inorganic layers and the refractive index of commonly used transparent conductive metal oxides, such as indium tin oxide (ITO) is often greater than 1.8 and often near 2.0. Hence, light emitted in a layer at a high angle with respect to the substrate normal can internally reflect and become trapped in the high optical-index materials of the layers and transparent electrodes; thereby reducing the efficiency of the LED device.

Because light may be emitted in all directions from the internal organic layers of the LED, some of the light may be emitted directly from the device, while some light is emitted into the device and either absorbed or reflected back out. Some of the light may be emitted laterally, or trapped and absorbed by the various layers comprising the device. Light generated from an LED device can be emitted through a top transparent electrode comprised of ITO, but it has been estimated that only about 20% of the generated light is actually emitted from such a device. The remaining light is trapped by internal reflections between layers and eventually absorbed.

Scattering techniques are known to improve the efficiency of light emission from an organic LED device. Chou (International Publication Number WO 02/37580) and Liu et al. (U.S. Patent Application Publication No. 2001/0026124) taught the use of a volume or surface scattering layer to improve light extraction. The scattering layer is applied next to the organic layers or on the outside surface of the glass substrate and has an optical index that matches these layers. Light produced within the organic LED device at higher than the critical angle, which would have otherwise been trapped, can penetrate the scattering layer and be scattered out of the device. The efficiency of the organic LED device is thereby improved. However, scattered light can propagate a considerable distance horizontally through the cover, substrate, or organic layers before being scattered out of the device, thereby reducing the sharpness of the device in pixelated applications such as displays. Scattering techniques cause light to pass through the light-absorbing material layers multiple times where they can be absorbed and converted to heat.

Therefore, a need exists to provide more effective ways to employ optical materials, such as color filters, light scattering materials, and auxiliary electrodes in LED display formats.

SUMMARY OF THE INVENTION

The aforementioned need is met according to the present invention by providing a method of making an inorganic light-emitting diode display having a plurality of light-emitting elements including providing a substrate, and forming a plurality of patterned electrodes over the substrate. A raised area is formed around each patterned electrode to provide a well before depositing a dispersion containing inorganic, light-emissive core/shell nano-particles into each well. The dispersion is dried to form a light-emitting layer including the inorganic, light-emissive core/shell nano-particles. An unpatterned, common electrode is formed over the light-emitting layer. The light-emitting layer emits light by the recombination of holes and electrons supplied by the electrodes.

Since device feature dimensions such as layer thicknesses are frequently in sub-micrometer ranges, the drawings are scaled for ease of visualization, rather than dimensional accuracy.

DETAILED DESCRIPTION OF THE INVENTION

Figure 7:
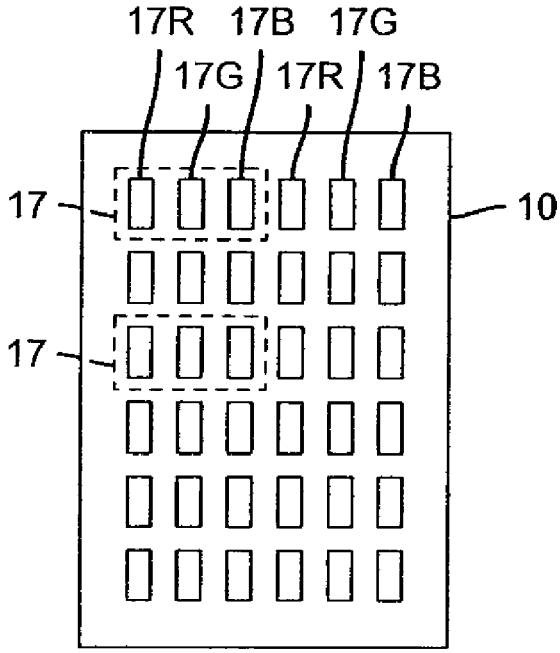
FIG. 7 PRIOR ART
FIG. 7 is a top view of a prior-art display having pixels with three light-emitting elements.

A color LED display emits light of at least one color. The term "multicolor" is employed to describe a display panel that is capable of emitting light of different hues in different areas. In particular, "multicolor" is employed to describe a display panel that is capable of displaying images of different colors. These areas are not necessarily contiguous. The term "full color" is employed to describe multicolor display panels that are capable of emitting in several regions of the visible spectrum and therefore displaying images in a large combination of hues. The red, green, and blue colors constitute the three primary colors from which all other colors can be generated by appropriate mixing. However, for this invention, "full-color" can include additional different colored pixels. The term "hue" refers to the intensity profile of light emission within the visible spectrum, with different hues exhibiting visually discernible differences in color. The term "pixel" designates an area of a display panel comprising a plurality of light-emitting areas that can be stimulated to emit light independently of other areas and with differently colored light. In full-color systems, pixels comprise light-emitting elements of different colors that are used together to generate a broad range of colors. A display typically employs a plurality of pixels. For example, in a three-color RGB full-color display, a pixel generally includes three primary-color pixels, namely red, green, and blue (RGB), which are color-gamut-defining pixels. Referring to FIG. 7, a prior-art display includes a plurality of pixels 17, each pixel having three light-emitting elements 17R, 17G, and 17B.

Figure 1:
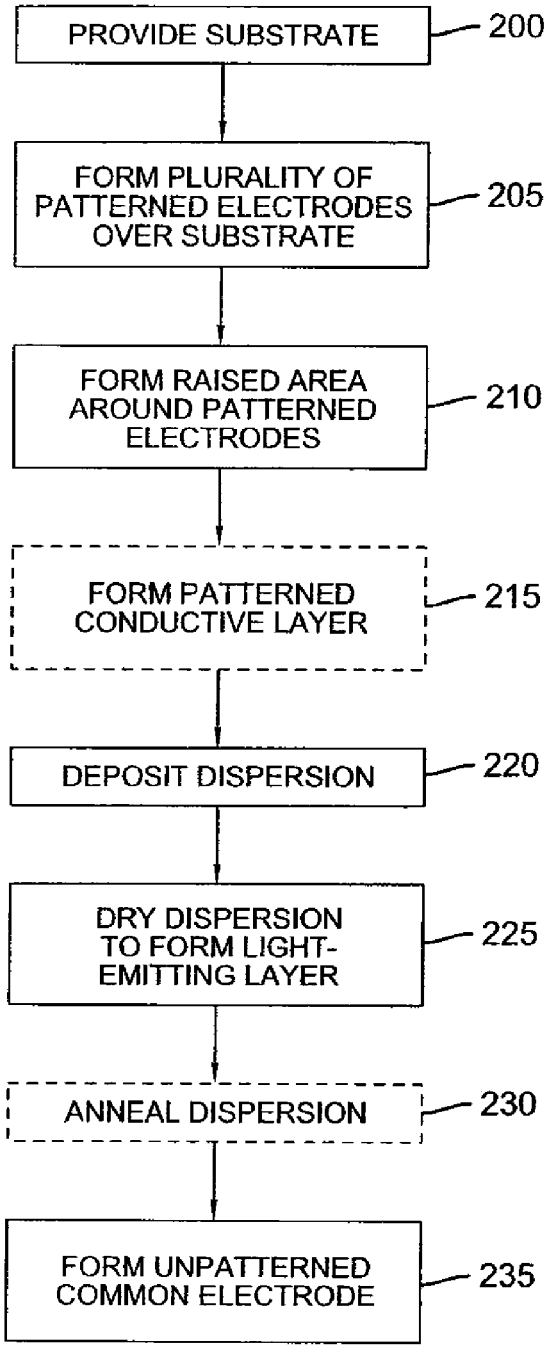
FIG. 1 is a flow diagram describing one exemplary embodiment of the method of this invention.

Referring to FIG. 1, a method of making an inorganic light-emitting diode display having a plurality of light-emitting elements includes providing a substrate in operation 200, forming a plurality of patterned electrodes over the substrate in operation 205, and forming a raised area around each patterned electrode in operation 210 to provide a well. A patterned conductor may optionally be formed in operation 215, between the plurality of patterned electrodes. A dispersion containing inorganic, light-emissive core/shell nano-particles is deposited in operation 220 into each well and dried in operation 225 to form a light-emitting layer comprising the inorganic, light-emissive core/shell nano-particles. The inorganic, light-emissive core/shell nano-particles may be quantum dots. Optionally, the dried dispersion may be annealed in operation 230 or sintered to form a fused, polycrystalline layer. An unpatterned, common electrode is then formed in operation 235 over the light-emitting layer. The light-emitting layer emits light by the recombination of holes and electrons supplied by the electrodes. In an alternative embodiment of the present invention, the patterned conductor may optionally be formed over the unpatterned, common electrode.

In another embodiment of the present invention, the method of the present invention may further comprise providing a plurality of conductive or semi-conductive nano-particles in the dispersion. Charge-management layers may also be employed between the patterned and unpatterned, common electrode to improve the injection, transport, or recombination of electrons and holes in the light-emitting core/shell nano-particle layer. Such layers may include hole-injection layers, hole-transport layers, electron-injection layers, and electron-transport layers.

Figure 2:
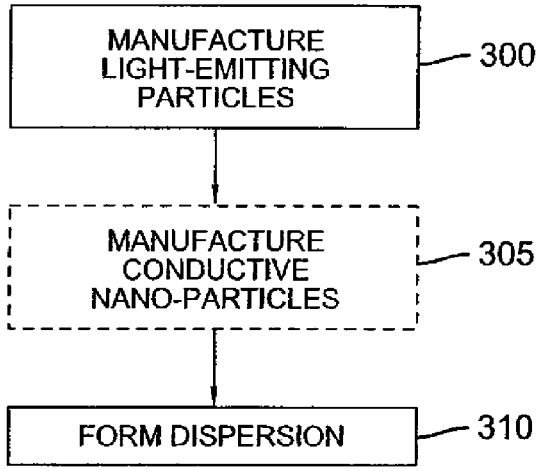
FIG. 2 is a flow diagram describing forming a dispersion as a part of one exemplary embodiment of the method of this invention.

Referring to FIG. 2, the dispersion may be formed by first manufacturing one or more types of light-emitting core/shell nano-particles in operation 300, for example, quantum dots. The core/shell nano-particles may be formed in a colloidal dispersion. Optionally, a plurality of conductive or semi-conductive nano-particles may be manufactured in operation 305 and added to form the dispersion in operation 310. The dispersion may be deposited by a variety of means, for example, by employing inkjet, spray, curtain, or hopper coating. In a further embodiment of the present invention, optical material may be deposited into one or more wells, for example by employing inkjet, spray, curtain, or hopper coating. The optical material is employed to change the optical characteristics or path of the emitted light and may include, for example, color filter material, a light-scattering material, or a liquid material that self-aligns to form a lenslet. A color filter may be employed to modify the spectrum of the emitted light while light-scattering material or lenslets may be employed to extract light that may travel through the light-emitting layer or charge-management layers.

Figure 3A:
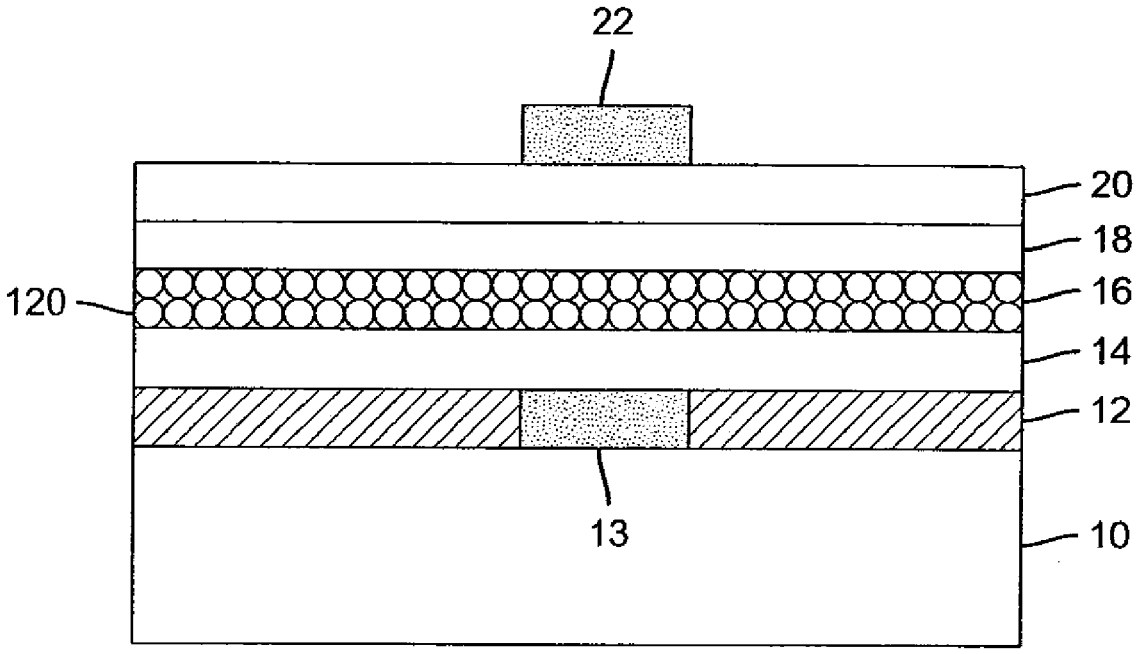
FIG. 3A is a cross-section of a device made according to one embodiment of the method of this invention.
Figure 3B:
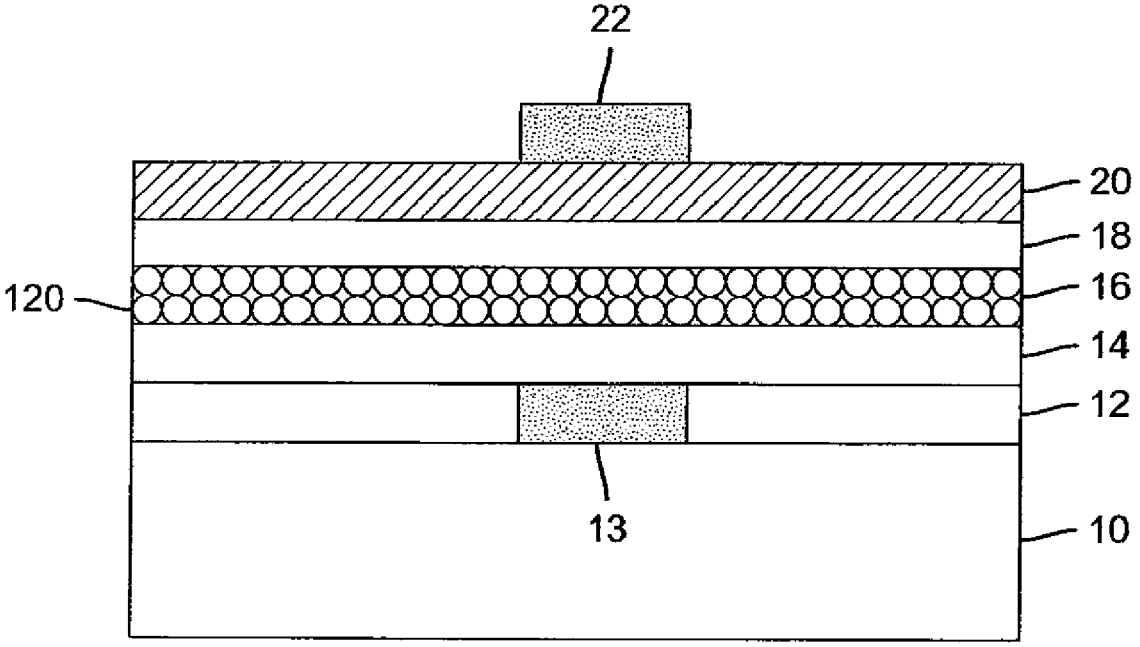
FIG. 3B is a cross-section of an alternative device made according to another embodiment of the method of this invention.

Referring to FIGS. 3A and 3B, in various embodiments of the present invention, the inorganic light-emitting diode display includes a plurality of patterned electrodes 12 separated by insulators 13. The inorganic light-emitting diode display may be a top emitter (FIG. 3A), in which the plurality of patterned electrodes 12 are light-reflective and the unpatterned, common electrode 20 is light-transmissive, or a bottom emitter (FIG. 3B), in which the patterned electrodes 12 are light-transmissive and the unpatterned, common electrode 20 is light-reflective. In the latter case, it may be important that the substrate be transparent as well. As shown in FIG. 3A, a substrate 10 is provided on which is formed a patterned, electrode 12 (in this embodiment, patterned electrode 12 is light-reflective), a charge-management layer 14, a light-emissive layer 16, a charge-management layer 18, and an unpatterned, common electrode 20 (in this embodiment, transparent). Light-emissive core/shell nano-particles 120 are contained within the light-emitting layer 16. In FIG. 3B, the patterned electrode 12 is transparent while the unpatterned, common electrode 20 is light-reflective. Light-emissive core/shell nano-particles 120 are contained within the light-emitting layer 16. The patterned electrode 12 may be patterned by employing insulating, planarization layers 32 between the electrodes 12 as shown subsequently in FIG. 4.

Figure 4:
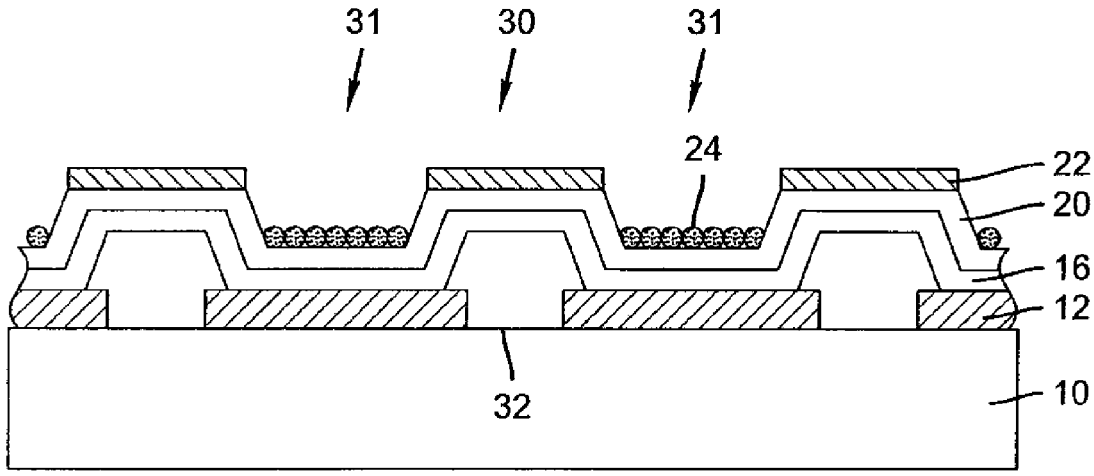
FIG. 4 is a cross-section of another device having optical materials and a patterned conductive layer made according to one embodiment of the method of this invention.

Referring to FIG. 4, a substrate 10 is provided on which is formed a patterned, electrode 12 (in this embodiment, the patterned electrode is light-reflective, as in FIG. 3A) separated by insulating, planarization layers 32, a light-emissive layer 16, and an unpatterned, common electrode 20 (in this embodiment, the unpatterned common electrode 20 is transparent). The insulating, planarization layers 32 form raised areas 30 around each patterned electrode 12 forming a well 31 at the bottom of which is the surface of the patterned electrode 12. Optical materials 24 are deposited in the wells 31 over the unpatterned, common electrode 20.

In an embodiment of the present invention wherein the unpatterned, common cathode 20 is transparent, the conductivity of the unpatterned, common electrode 20 may be lower than desired. The conductivity of the unpatterned, common electrode 20 may be enhanced by forming a patterned conductive layer 22 in electrical contact with the common, unpatterned electrode 20. In alternative embodiments of the present invention, the patterned conductive layer 22 may be disposed over the unpatterned, common conductive layer 20 or the patterned conductive layer 22 may be located at least partially on the raised areas 30. The patterned conductive layer 22 may be substantially in contact with the common, unpatterned electrode 20 in the raised areas 30 and substantially free from contact with the common, unpatterned electrode 20 in the areas within the well 31.

Figure 5:
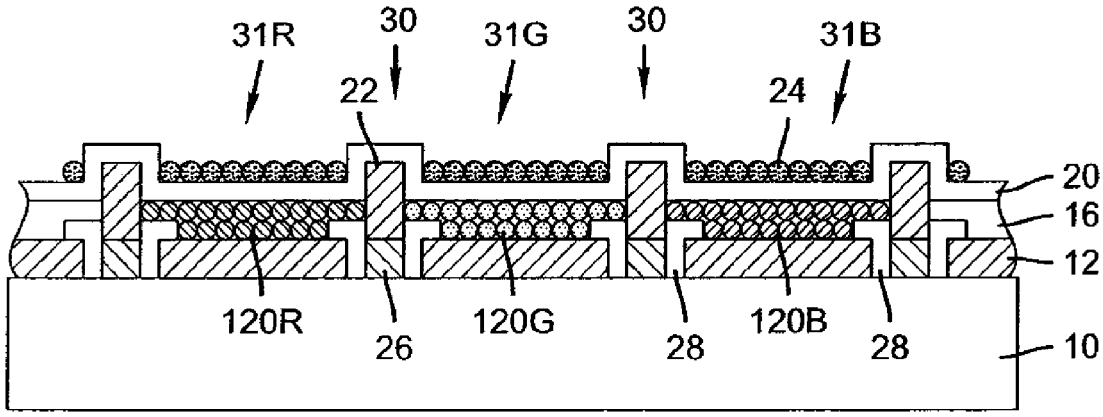
FIG. 5 is a cross-section of a device in an alternative configuration having optical materials and a patterned conductive layer made according to an exemplary embodiment of the method of this invention.
Figure 8:
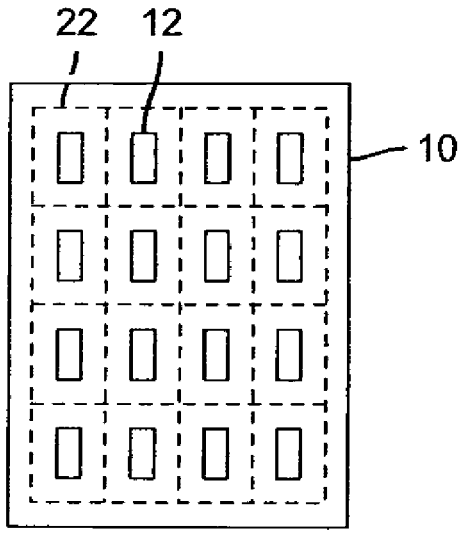
FIG. 8 is a top view of patterned substrate useful for the present invention.

Referring to FIG. 5, in an alternative embodiment of the present invention, the patterned conductive layer 22 forms the raised areas 30. The patterned, conductive layer 22 may be in electrical contact with current-carrying busses 26, separated by insulators 28, to expedite the conduction of current to the unpatterned, common electrode 20. Referring to FIG. 8, in a top view of FIG. 5 with multiple patterned conductive layers 22, patterned electrodes 12 are formed over a substrate 10 with a patterned conductive layer 22 formed between the patterned electrodes 12 to form a conductive grid pattern.

Patterned conductive layer 22 can be a metal that is a good conductor, including, but not limited to aluminum, copper, magnesium, molybdenum, silver, titanium, gold, tungsten, nickel, chromium, or alloys thereof. Patterned conductive layer 22 can include a bilayer structure of two different metals, or a metal and a semiconductor, or a conductive polymer. Insulating planarization layers 32 can be organic, inorganic, or an inorganic/organic composite. Insulating planarization layers 32 can include almost any patternable organic polymer including, but not limited to cyanoacrylates, polyimides, methacrylates, or nitrocellulose. Photoresist polymeric materials are particularly useful. Non-limiting examples of inorganic materials for insulating planarization layers layer 32 include insulating metal oxides, such as those formed from sol-gel solutions or formed by evaporative deposition. Insulating planarization layers layer 32 should be selected so as not to degrade inorganic LED performance, e.g., by outgassing harmful materials, corroding the patterned conductive layer, or contaminating the inorganic LED.

The present invention may be employed to form a full-color display device, for example, by employing different light-emitting particles 120 in different wells 31 stimulated by current from the patterned electrodes 12. Referring again to FIG. 5, a plurality of dispersions, each dispersion containing different inorganic, light-emissive particles 120R, 120G, 120B that emit different colors of light red, green, and blue respectively, may be deposited into different wells 31R, 31G, 31B, respectively. In such an embodiment, it is important that the different light-emissive particles 120R, 120G, 120B not be mixed in with light-emitting core/shell nano-particles in wells 31 having different light-emitting particles 120. Hence, according to another embodiment of the present invention, the dispersion does not fill the well 31 and the raised areas 30 serve as barriers to prevent the diffusion of dispersions from one well 31 to another. To facilitate such a barrier, it may be helpful for the wells to be one-to-five microns deep.

Figure 6:
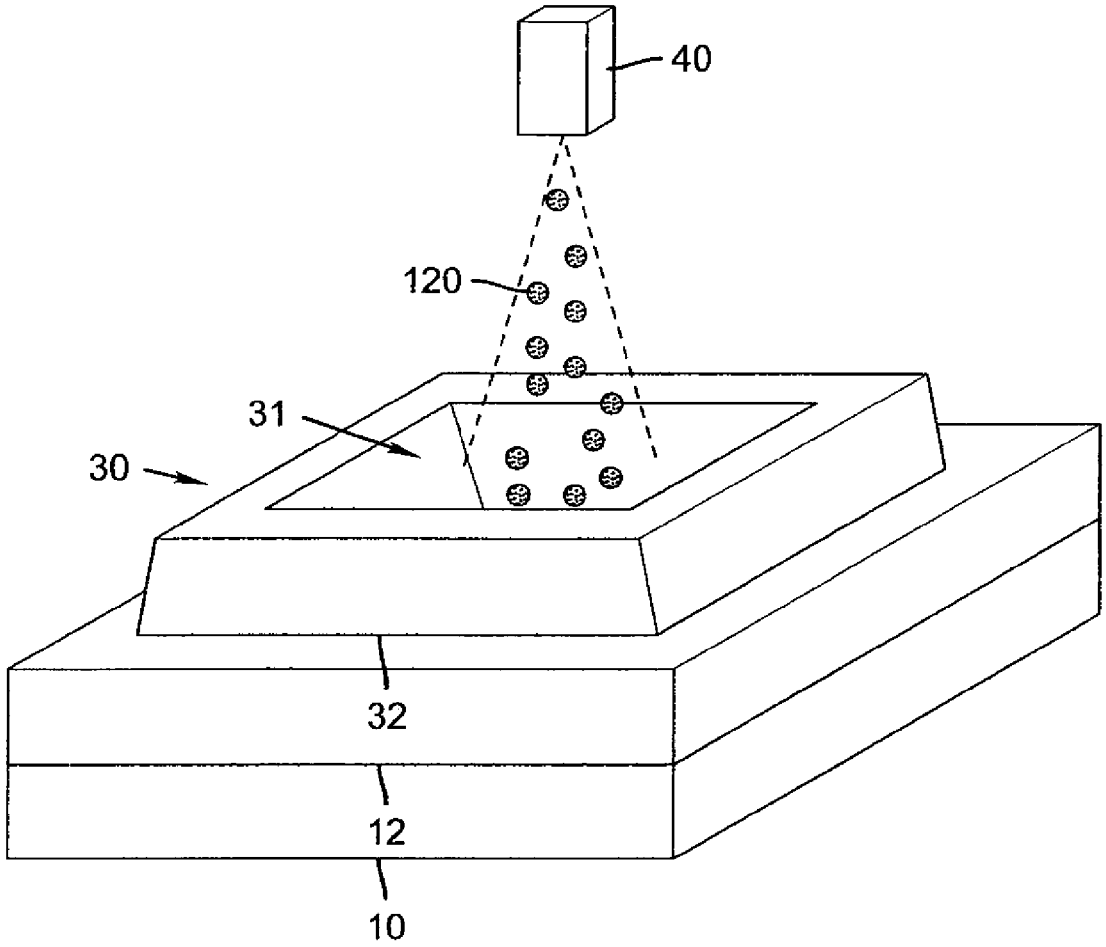
FIG. 6 is a three-dimensional view of a light-emitting element and an inkjet device illustrating a process for making a device according to an embodiment of this invention.

As noted above, the dispersion may be deposited by a variety of means, for example, by employing inkjet, spray, curtain, or hopper coating. Referring to FIG. 6, a patterned electrode 12 is formed over a substrate 10. A planarization layer 32 forms a raised area 30 and a well 31 in which inorganic, light-emitting core/shell nano-particles 120 may be deposited by an inkjet device 40. A spray system may operate in a similar way, but without employing different dispersions, as may be useful, for example, in a white-light-emitting system with color filters.

The present invention may be employed in both active- and passive-matrix embodiments. In an active-matrix display, the patterned electrode 12 is individually addressable, while the unpatterned, common electrode is shared by many or all inorganic LED devices. Each pixel is controlled independently with, for example, thin film transistors (TFTs). Such TFTs can be constructed using amorphous silicon, low temperature polycrystalline silicon, single crystal silicon, other inorganic semiconductors, or organic semiconductor materials. The bottom, patterned electrodes 12 are most commonly configured as anodes, and common light-transmissive electrode 20, which is the top electrode, is most commonly configured as the cathode. However, the practice of this invention is not limited to this configuration.

Optical material 24 can include, e.g. a colorant for forming a color filter, a color conversion material, a light-scattering material, or a lenslet. A color filter is a material that absorbs radiation of certain frequencies (e.g. by using a light absorbing dye or pigment), but transmits radiation of other frequencies, thereby altering (filtering) the spectrum. A light-scattering material redirects a substantial portion of the light that strikes the light-scattering material. A lenslet focuses light that passes through it. More than one optical material can be provided in one or more wells. If optical material 24 is a colorant, different wells 31 are deposited with different colorants to provide a color filter array. For example, referring back to FIG. 5, some wells 31 are provided with a red colorant, some with a green colorant, and some with a blue colorant, such that a light-emitting layer 16 that emits white light can be used to form a full-color inorganic LED display.

If protective layers are formed over the wells 31, or a plurality of optical materials 24 are provided in one or more of the wells 31 in one or more deposition steps, it can be useful to have much deeper wells, for example, at least five microns deep. Alternatively, relatively deep wells are useful if a relatively large volume of optical materials is needed. Relatively deep wells are also useful for providing an improved ambient contrast ratio by placing a light-absorbing material on the raised areas 30.

Optical material 24 can be deposited into the wells 31 in many ways. When patterning is required, such as for providing color filters, the optical material can be provided into wells 31 by ink jet deposition, but other means such as patterned laser transfer or screen-printing can also be useful. The formation of color filter arrays by ink jet deposition has been described, for example, in U.S. Pat. Nos. 6,909,477; 6,874,883, U.S. Patent Application Publication Nos. 2005/0100660 and 2002/0128351. When patterning is not required, such as when all the wells 31 are to be filled by the same optical material, Cain coating, spin coating, drop coating, spray coating and other related methods can be used. For example, light-scattering materials can be deposited this way and most of such material will flow into the wells 31. However, ink jet and other methods are still useful even when all the wells 31 have the same optical material 24.

Patterned conductive layer 22 can optionally act as a black matrix to absorb light to increase the contrast of an inorganic LED display. Brightness and/or lifetime of the inorganic LED display can be increased. The sharpness of the LED display can also be improved, because unwanted emitted light that might otherwise be internally reflected within the layers of the LED display device can be absorbed by the light-absorbing material. In one embodiment, the light-absorbing material forms patterned conductive layer 22, e.g. a black silver compound. Silver is a highly thermally and electrically conductive material and can be made light absorbing through electrochemical processes known in the art; for example, it can be oxidized and reduced. The deposition and patterning process for the light-absorbing patterned conductive layer 22 is done through the use of conventional photo-resistive processes. Silver compounds are suggested in the prior art as candidates for electrodes, for example, magnesium silver compounds. Other suitable materials include aluminum, copper, magnesium, titanium, or alloys thereof.

In a particularly useful embodiment, the patterned conductive layer 22 can include metal nanoparticles deposited in the desired pattern by laser transfer from a donor, as described in commonly assigned U.S. patent application Ser. No. 11/130,772. In this method, relatively thick layers of the patterned conductive layer 22 can be prepared. For example, metal nanoparticles having a particle size of two-four nanometers can be prepared and mixed with an IR-absorbing dye in an organic solution, and then uniformly coated onto a donor sheet and dried. The thickness of the dried metal nanoparticle layer can be very thin or up to 2 um or more. The donor sheet can be placed adjacent (preferably in contact) to the unpatterned, common light transmissive electrode 20. By patterned radiation, preferably by laser radiation, the IR dye absorbs radiation to produce heat that causes annealing of the metal nanoparticles. When the donor sheet is removed, the annealed metal nanoparticles remain on the light-transmissive electrode 20.

In another embodiment, light-absorbing material can be part of the patterned insulating, planarization layer 32. The light-absorbing material can include a metal oxide, metal sulfide, silicon oxide, silicon nitride, carbon, a light-absorbing polymer, a polymer doped with an absorbing dye, or combinations thereof. Preferably, the light-absorbing material is black and can include further anti-reflective coatings.

In another embodiment, one method of forming the patterned conductive layer 22, a uniform coating of conductive material is uniformly deposited over the top transmissive electrode, e.g., by evaporation or sputtering. Next a layer (not shown) is provided over the conductive layer. The layer is patterned using conventional photolithographic, or thermal transfers or adhesive transfer, or ablative transfer, or other techniques and is used as an etch mask to pattern conductive layer 22. Although polymer etch masks are typically removed, it may be advantageous in the present invention to leave the patterned layer in place, thereby, reducing manufacturing steps and improving cycle times.

The patterned layer may be used as an etch mask to pattern the conductive layer to form the patterned conductive layer 22. This can be done several ways, depending on the nature of the conductive layer and of the underlying common light-transmissive electrode 20. A well-known light-transmissive electrode includes indium tin oxide (ITO). The conductive layer can be patterned by chemical etching, e.g. a silver conductive layer can be removed by treatment with a ferric nitrate solution. Alternatively, the conductive layer can be patterned by plasma etching, e.g. if the conductive layer is aluminum. Chlorine plasma etching of aluminum is well-known. A chlorine plasma can be generated by treating a chlorinated compound (e.g. $CCl_4$, $CHCl_3$, $BCl_3$, or even chlorine gas) with an electric discharge. This step will convert the uniform conductive layer into patterned conductive layer 22 and complete the process of forming the patterned conductive layer 22, and the wells 31.

The optical material 24 in the wells 31 may be light-scattering material. Light-scattering material can include a volume scattering layer or a surface scattering layer. In certain embodiments, light-scattering material can include components having at least two different refractive indices. Light-scattering material can include, e.g., a matrix of lower refractive index and scattering elements having a higher refractive index. Alternatively, the matrix can have a higher refractive index and the scattering elements can have a lower refractive index. For example, the matrix can include silicon dioxide or cross-linked resin having indices of approximately 1.5, or silicon nitride with a much higher index of refraction. If light-scattering material has a thickness greater than one-tenth of the wavelength of the emitted light, then it is desirable for the index of refraction of at least one component of the light-scattering material to be approximately equal to or greater than the refractive index of the layer it contacts, that is unpatterned, common light-transmissive electrode 20 in this case. This is to insure that all of the light trapped in the electrode can experience the direction altering effects of the light-scattering material. If light-scattering material has a thickness less than one-tenth part of the wavelength of the emitted light, then the materials in the scattering layer need not have such a preference for their refractive indices. In one embodiment, the matrix of lower refractive index has an optical refractive index matched to that of common light-transmissive electrode.

In an alternative embodiment, light-scattering material can include particles deposited on another layer, e.g., particles of titanium dioxide can be coated over unpatterned, common light-transmissive electrode 20 to scatter light. Preferably, such particles are at least 100 nm in diameter to optimize the scattering of visible light. The light-scattering material is typically adjacent to, and in contact with unpatterned, common light-transmissive electrode 20 to defeat total internal reflection in the light-emissive layer 16 and unpatterned, common light-transmissive electrode 20. According to an embodiment of the present invention, the light-emissive layers and electrodes combined can form a waveguide for some of the emitted light, since the light-emissive layers may have a refractive index lower than that of the transparent electrode 20 and the bottom patterned electrode 12 is reflective. The light-scattering material disrupts the total internal reflection of light in the light-emissive, charge-management, and transparent electrode layers and redirects some portion of the light out of the layers.

Light-scattering material can include organic materials (for example polymers or electrically conductive polymers) or inorganic materials. The organic materials can include, e.g., one or more of polythiophene, PEDOT, PET, or PEN. The inorganic materials can include, e.g., one or more of $SiO_x$ ($x>1$), $SiN_x$ ($x>1$), $Si_3N_4$, $TiO_2$, MgO, ZnO, $Al_2O_3$, $SnO_2$, $In_2O_3$, $MgF_2$, and $CaF_2$. Light-scattering material can include, for example, silicon oxides and silicon nitrides having a refractive index of 1.6 to 1.8 and doped with titanium dioxide having a refractive index of 2.5 to 3. Polymeric materials having refractive indices in the range of 1.4 to 1.6 can be employed having a dispersion of refractive elements of material with a higher refractive index, for example randomly located spheres of titanium dioxide can be employed in a matrix of polymeric material. Alternatively, a more structured arrangement employing indium-tin oxide, silicon oxides, or silicon nitrides can be used. Shapes of refractive elements can be cylindrical, rectangular, or spherical, but it is understood that the shape is not limited thereto. The difference in refractive indices between components of the light-scattering material can be, for example, from 0.3 to 3, and a large difference is generally desired. The thickness of the light-scattering material, or size of features in, or on the surface of, a scattering layer can be, for example, 0.03 to 50 μm. It is generally preferred to avoid diffractive effects in the light-scattering material. Such effects can be avoided, for example, by locating features randomly or by ensuring that the sizes or distribution of the refractive elements are not the same as the wavelength of the color of light emitted by the device from the light-emitting area.

It is known that particles of different sizes in a scattering layer can have different optical effects dependent on wavelength. Hence, in a further embodiment of the present invention, particles having different size distributions are deposited into different wells representing different colored light-emitting elements. In various alternative embodiments, the particles and/or the matrix material itself can be colored and form a color filter in a single layer. For example, a resin or polymer can have colorants such as dyes or pigments. Pigment particles can also serve as a scattering material.

In an alternative embodiment, optical materials 24 are deposited in one or more layers to provide a variety of optical effects in the various layers. For example, a scattering layer can be formed over the transparent electrode within a well and another color filter layer formed over the scattering layer. Alternatively, the color filter layer can be located beneath the scattering layer. These layers can be formed in separate deposition steps using the same or different equipment for depositing the layers.

Other optical effects can be desired and employed in the optical materials 24. For example, neutral density filters can be formed by employing carbon black in a polymer matrix as an optical layer. In an alternative embodiment, separate layers of optical materials 24 can have differing indices that, together, form an optical filter by employing constructive and deconstructive optical effects.

In an alternative embodiment of the present invention, an environmentally protective layer (not shown) can be located over the transparent electrode either beneath or over the optical materials. For example, aluminum oxide-based materials, zinc oxide-based materials, or parylene can deposited over the transparent electrode and beneath the optical materials.

According to one embodiment of the present invention, a light-emitting diode (LED) device comprises a substrate, one-or-more thin-film transistors located over the substrate, one or more light-emitting elements formed over the thin-film transistors, wherein each light-emitting element comprises, a first extensive electrode formed between or over at least a portion of the one-or-more thin-film transistors, at least one inorganic light-emitting layer comprising randomly-located light-emissive particles formed over the first extensive electrode, and a second reflective electrode formed over the at least one layer of light-emitting material. The light-emitting layer may be formed as a colloidal dispersion, deposited on a surface, dried, and annealed. Additional non-light-emitting, electrically conductive or semi-conductive particles may be included in the dispersion and, once dried, the dispersion may be annealed to form a polycrystalline, semi-conductor matrix. The polycrystalline semiconductor matrix then comprises the light-emitting layer. The use of an inorganic light-emitting layer according to an embodiment of the present invention provides advantages in performance. Because other prior-art light-emitting particle (e.g. quantum dot) device are formed using, for example, epitaxial methods, the light-emitting particles (e.g. quantum dots) may be aligned within a structure; for example, placing quantum dots in particular locations in a plurality of layers, similar to a crystal structure. Such an arrangement and process may be very slow and damage underlying layers, for example the thin-film transistors, and may not be suitable for forming a light-emitting device with structures similar to those of the present invention. Moreover, the regular arrangement of quantum dots may lead to diffraction effects or light filtering effects in emitted light or reflected ambient light. Hence, a light-emitting polycrystalline layer comprising randomly located nano-particles (e.g. quantum dots) may provide an advantage.

In various embodiments of the present invention, electrically conductive transparent layers and/or electrodes may be formed from metal oxides or metal alloys having an optical index of 1.8 or more. For example, organic devices typically employ sputtered indium tin oxide whose optical index may be in the range of 1.8 to 2.0. As taught in the prior art, such a metal oxide with such an optical index will cause a greater amount of light trapping, thereby reducing the light efficiency of such prior-art devices. According to various embodiments of the present invention, a transparent electrode, for example, tin oxide, has an optical index greater or equal to the optical index of the light-emissive layer. Hence, a transparent electrode with a greater optical index is preferred and may be formed by additional annealing steps, deposition at higher temperatures, or by employing materials having a greater optical index, as is known in the art. In an inorganic embodiment of the present invention, p-type and/or an n-type charge-injection, charge-transport, or charge-blocking layers 14 and 18, respectively, optionally employed to provide charge control, are typically formed from metal alloys and have optical indices of approximately greater than 1.8.

Substrates on which light-emitting devices are formed typically comprise glass or plastic, having an optical index of approximately 1.5. Hence, it will generally be the case that the electrodes 12, 20 and any charge-injection, charge-transport, and/or charge-blocking layers 14, 18 formed between the light-emitting layer 16 and either of the electrodes 12, 16, will have a refractive index greater than the refractive index of the substrate 10. Useful material for electrodes includes ITO, CdSe, ZnTe, SnO2, and AlZnO. These materials have typical refractive indices in the range of 1.8 to 2.7. Useful inorganic materials for charge-control layers include CdZnSe and ZnSeTe. In another embodiment of the present invention, the transparent electrode has an optical index greater than or equal to the optical index of the charge-control layers. Organic materials are also known in the art. Reflective electrodes may comprise evaporated or sputtered metals or metal alloys, including Al, Ag, and Mg and alloys thereof. Deposition processes for these materials are known in the art and include sputtering and evaporation. Some materials may also be deposited using ALD or CVD processes, as are known in the art. However, organic materials are more environmentally sensitive and may have limited lifetimes compared to inorganic materials.

Figure 9:
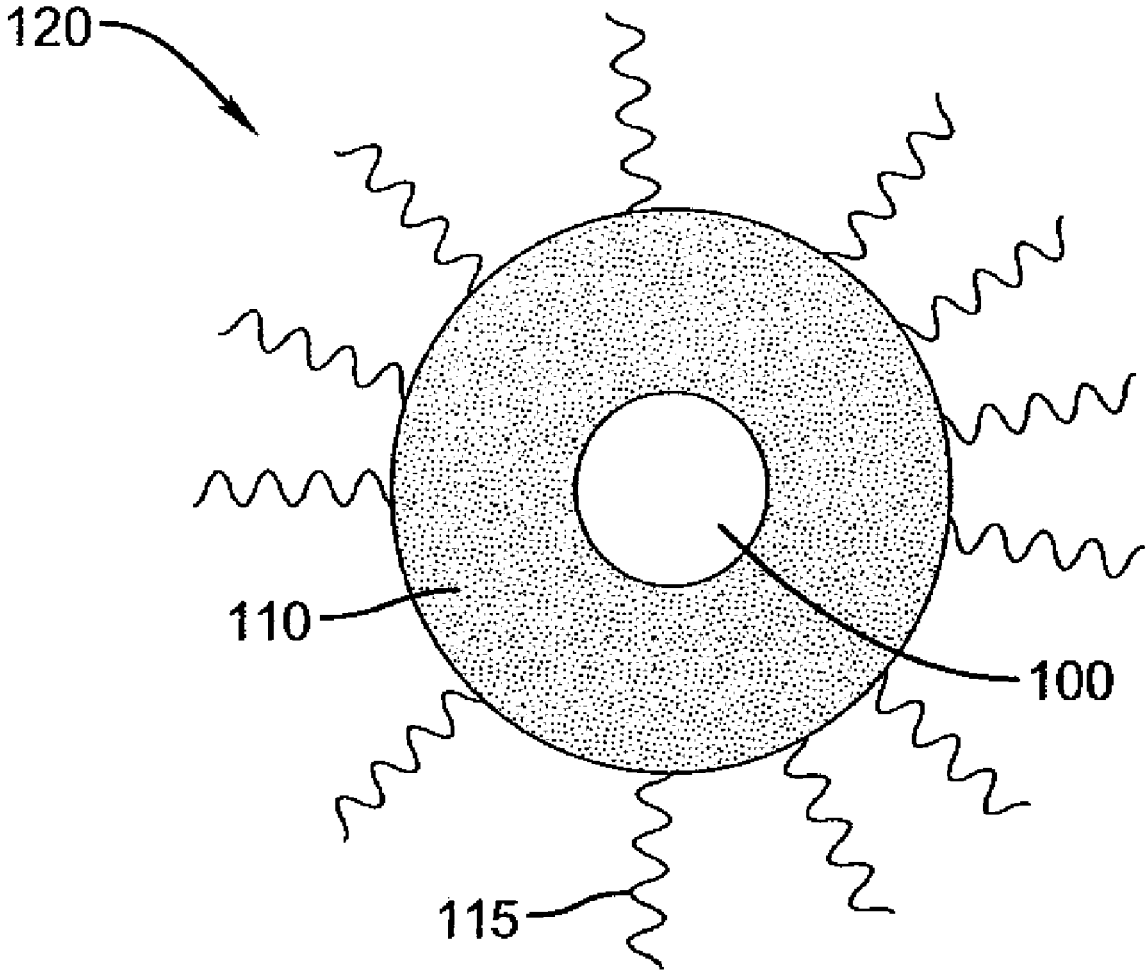
FIG. 9 is a cross section of an inorganic light-emitting particle useful in an embodiment of the present invention.
Figure 10:
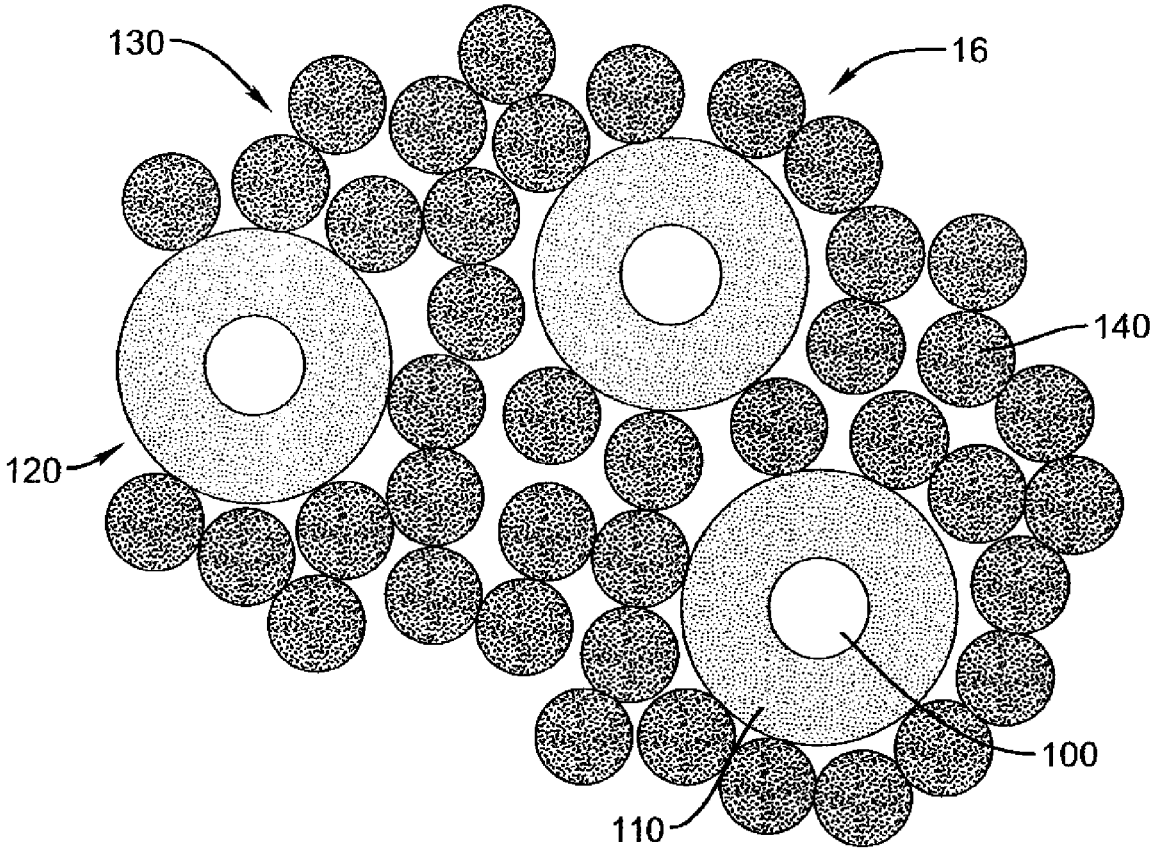
FIG. 10 is a cross section of an agglomeration of inorganic light-emitting particles and non-light-emitting, electrically conductive or semi-conductive particles useful in an embodiment of the present invention.

In other embodiments of the present invention and as illustrated in FIGS. 9 and 10, light-emitting layer 16 may comprise a layer of light-emitting core/shell nano-particles 120, e.g. quantum dots, together with semi-conductive, non-emissive particles 140 located in the layer. The particles 140 may improve transfer of energy into the light-emissive particles 18. Such semi-conductive particles, for example, nano-particles, are known in the art. Agglomerations 130 of light-emissive core/shell nano-particles 120 and, optionally, semi-conductive, non-emissive particles 140 forming a polycrystalline, semi-conductor matrix may be considered to be within the present invention, as single particles located within the light-emissive layer 16.

Referring to FIGS. 9 and 10, for one embodiment of the present invention, the light-emissive core/shell nano-particles 120 are quantum dots. Using quantum dots as the emitters in light-emitting diodes confers the advantage that the emission wavelength can be simply tuned by varying the size of the quantum dot particle. As such, spectrally narrow (resulting in a larger color gamut), multi-color emission can occur. If the quantum dots are prepared by colloidal methods [and not grown by high vacuum deposition techniques (S. Nakamura et al., Electronics Letter 34, 2435 (1998))], then the substrate no longer needs to be expensive or lattice matched to the LED semiconductor system. For example, the substrate could be glass, plastic, metal foil, or Si. Forming quantum dot LEDs using these techniques is highly desirably, especially if low-cost deposition techniques are used to deposit the LED layers.

A schematic of a core/shell quantum dot 120 emitter is shown in FIG. 9. The particle contains a light-emitting core 100, a semiconductor shell 110, and organic ligands 115. Since the size of typical quantum dots is on the order of a few nanometers and commensurate with that of its intrinsic exciton, both the absorption and emission peaks of the particle are blue-shifted relative to bulk values (R. Rossetti et al., Journal of Chemical Physics 79, 1086 (1983)). As a result of the small size of the quantum dots, the surface electronic states of the dots have a large impact on the dot's fluorescence quantum yield. The electronic surface states of the light-emitting core 100 can be passivated either by attaching appropriate (e.g., primary amines) organic ligands 115 to its surface or by epitaxially growing another semiconductor (the semiconductor shell 110) around the light-emitting core 100. The advantages of growing the semiconductor shell 110 (relative to organically passivated cores) are that both the hole and electron core particle surface states can be simultaneously passivated, the resulting quantum yields are typically higher, and the quantum dots are more photostable and chemically robust. Because of the limited thickness of the semiconductor shell 110 (typically 1-2 monolayers), its electronic surface states also need to be passivated. Again, organic ligands 115 are the common choice. Taking the example of a CdSe/ZnS core/shell quantum dot 120, the valence and conduction band offsets at the core/shell interface are such that the resulting potentials act to confine both the holes and electrons to the core region. Since the electrons are typically lighter than the heavier holes, the holes are largely confined to the cores, while the electrons penetrate into the shell and sample its electronic surface states associated with the metal atoms (R. Xie et al., Journal of the American Chemical Society 127, 7480 (2005)). Accordingly, for the case of CdSe/ZnS core/shell quantum dots 120, only the shell's electron surface states need to be passivated; an example of a suitable organic ligand 115 would be one of the primary amines which forms a donor/acceptor bond to the surface Zn atoms (X. Peng et al., Journal of the American Chemical Society 119, 7019 (1997)). In summary, typical highly luminescent quantum dots have a core/shell structure (higher bandgap surrounding a lower band gap) and have non-conductive organic ligands 115 attached to the shell's surface.

Colloidal dispersions of highly luminescent core/shell quantum dots have been fabricated by many workers over the past decade (O. Masala and R. Seshadri, Annual Review of Material Research 34, 41 (2004)). The light-emitting core 100 is composed of type IV (Si), III-V (InAs), or II-VI (CdTe) semiconductive material. For emission in the visible part of the spectrum, CdSe is a preferred core material since by varying the diameter (1.9 to 6.7 nm) of the CdSe core; the emission wavelength can be tuned from 465 to 640 nm. As is well known in the art, visible-light emitting quantum dots can be fabricated from other material systems, such as, doped ZnS (A. A. Bol et al., Phys. Stat. Sol. B224, 291 (2001)). The light-emitting cores 100 are made by chemical methods well known in the art. Typical synthetic routes are decomposition of molecular precursors at high temperatures in coordinating solvents, solvothermal methods (disclosed by O. Masala and R. Seshadri, Annual Review of Material Research 34, 41 (2004)), and arrested precipitation (disclosed by R. Rossetti et al., Journal of Chemical Physics 80, 4464 (1984)). The semiconductor shell 110 is typically composed of type II-VI semiconductive material, such as, CdS or ZnSe. The shell semiconductor is typically chosen to be nearly lattice matched to the core material and have valence and conduction band levels such that the core holes and electrons are largely confined to the core region of the quantum dot. Preferred shell material for CdSe cores is $ZnSe_xS_{1-x}$, with x varying from 0.0 to ~0.5. Formation of the semiconductor shell 110 surrounding the light emitting core 100 is typically accomplished via the decomposition of molecular precursors at high temperatures in coordinating solvents (M. A. Hines et al., Journal of Physical Chemistry 100, 468 (1996)) or reverse micelle techniques (A. R. Kortan et al., Journal of the American Chemical Society 112, 1327 (1990)).

As is well known in the art, two low-cost means for forming quantum dot films are: (1) depositing the colloidal dispersion of core/shell quantum dots 120 by drop casting and spin casting. Alternatively, (2) spray deposition or inkjet may be employed. Common solvents for drop casting quantum dots are a 9:1 mixture of hexane:octane (C. B. Murray et al., Annual Review of Material Science 30, 545 (2000)). The organic ligands 115 need to be chosen such that the quantum dot particles are soluble in hexane. As such, organic ligands with hydrocarbon-based tails are good choices, such as, the alkylamines. Using well-known procedures in the art, the ligands coming from the growth procedure (TOPO, for example) can be exchanged for the organic ligand 115 of choice (C. B. Murray et al., Annual Review of Material Science 30, 545 (2000)). When depositing a colloidal dispersion of quantum dots, the requirements of the solvent are that it easily spreads on the deposition surface and the solvents evaporate at a moderate rate during the deposition process. It was found that alcohol-based solvents are a good choice; for example, combining a low boiling point alcohol, such as, ethanol, with higher boiling point alcohols, such as, a butanol-hexanol mixture, resulting in good film formation. Correspondingly, ligand exchange can be used to attach an organic ligand (to the quantum dots) whose tail is soluble in polar solvents; pyridine is an example of a suitable ligand. The quantum dot films resulting from these two deposition processes are luminescent, but non-conductive. The films are resistive, since non-conductive organic ligands separate the core/shell quantum dot particles 120. The films are also resistive, since as mobile charges propagate along the quantum dots, the mobile charges get trapped in the core regions due to the confining potential barrier of the semiconductor shell 110.

Proper operation of inorganic LEDs typically requires low resistivity n-type and p-type transport layers, surrounding a conductive (nominally doped) and luminescent emitter layer. As discussed above, typical quantum dot films are luminescent, but insulating. FIG. 10 schematically illustrates a way of providing an inorganic light-emitting layer 16 (shown in FIGS. 3-5) that is simultaneously luminescent and conductive. The concept is based on co-depositing small (<2 nm), conductive inorganic nanoparticles 140 along with the core/shell quantum dots 120 to form the inorganic light-emitting layer 16. A subsequent inert gas (Ar or $N_2$) anneal step is used to sinter the smaller inorganic nanoparticles 140 amongst themselves and onto the surface of the larger core/shell quantum dots 120. Sintering the inorganic nanoparticles 140, results in the creation of a conductive, polycrystalline, semiconductor agglomeration 130 useful in light-emitting layer 16 or forming a matrix in layer 16. Through the sintering process, this agglomeration 130 is also connected to the core/shell quantum dots 120. As such, a conductive path is created from the edges of the inorganic light-emitting layer 16, through the semiconductor agglomeration 130 and to each core/shell quantum dot 120, where electrons and holes recombine in the light emitting cores 100. It should also be noted that encasing the core/shell quantum dots 120 in the conductive, polycrystalline, semiconductor agglomeration 130 has the added benefit that it protects the quantum dots environmentally from the effects of both oxygen and moisture.

The inorganic nanoparticles 140 may be composed of conductive semiconductive material, such as, type IV (Si), III-V (GaP), or II-VI (ZnS or ZnSe) semiconductors. In order to easily inject charge into the core/shell quantum dots 120, it is preferred that the inorganic nanoparticles 140 comprise a semiconductor material with a band gap comparable to that of the semiconductor shell 110 material, more specifically a band gap within 0.2 eV of the shell material's band gap. For the case that ZnS is the outer shell of the core/shell quantum dots 120, then the inorganic nanoparticles 140 are composed of ZnS or ZnSSe with a low Se content. The inorganic nanoparticles 140 are made by chemical methods well known in the art. Typical synthetic routes are decomposition of molecular precursors at high temperatures in coordinating solvents, solvothermal methods (O. Masala and R. Seshadri, Annual Review of Material Research 34, 41 (2004)), and arrested precipitation (R. Rossetti et al., J. Chem. Phys. 80, 4464 (1984)). As is well known in the art, nanometer-sized nanoparticles melt at a much-reduced temperature relative to their bulk counterparts (A. N. Goldstein et al., Science 256, 1425 (1992)). Correspondingly, it is desirable that the inorganic nanoparticles 140 have diameters less than 2 nm in order to enhance the sintering process, with a preferred size of 1-1.5 nm. With respect to the larger core/shell quantum dots 120 with ZnS shells, it has been reported that 2.8 nm ZnS particles are relatively stable for anneal temperatures up to 350° C. (S. B. Qadri et al., Physics Review B60, 9191 (1999)). Combining these two results, the anneal process has a preferred temperature between 250 and 300° C. and a duration up to 60 minutes, which sinters the smaller inorganic nanoparticles 140 amongst themselves and onto the surface of the larger core/shell quantum dots 120, whereas the larger core/shell quantum dots 120 remain relatively stable in shape and size.

To form an inorganic light-emitting layer 16, a co-dispersion of inorganic nanoparticles 140 and core/shell quantum dots 120 may be formed. Since it is desirable that the core/shell quantum dots 120 be surrounded by the inorganic nanoparticles 140 in the inorganic light-emitting layer 16, the ratio of inorganic nanoparticles 140 to core/shell quantum dots 120 is chosen to be greater than 1:1. A preferred ratio is 2:1 or 3:1. Depending on the deposition process, such as, spin casting or drop casting, an appropriate choice of organic ligands 115 is made. Typically, the same organic ligands 115 are used for both types of particles. In order to enhance the conductivity (and electron-hole injection process) of the inorganic light emitting layer 16, it is preferred that the organic ligands 115 attached to both the core/shell quantum dots 120 and the inorganic nanoparticles 140 evaporate as a result of annealing the inorganic light emitting layer 16 in an inert atmosphere. By choosing the organic ligands 115 to have a low boiling point, they can be made to evaporate from the film during the annealing process (C. B. Murray et al., Annual Review of Material Science 30, 545 (2000)). Consequently, for films formed by drop casting, shorter chained primary amines, such as, hexylamine are preferred; for films formed by spin casting, pyridine is a preferred ligand. Annealing thin films at elevated temperatures can result in cracking of the films due to thermal expansion mismatches between the film and the substrate. To avoid this problem, it is preferred that the anneal temperature be ramped from 25° C. to the anneal temperature and from the anneal temperature back down to room temperature. A preferred ramp time is on the order of 30 minutes. The thickness of the resulting inorganic light-emitting layer 16 should be between 10 and 100 nm.

Following the anneal step, the core/shell quantum dots 120 would be devoid of an outer shell of organic ligands 115. For the case of CdSe/ZnS quantum dots, having no outer ligand shell would result in a loss of free electrons due to trapping by the shell's unpassivated surface states (R. Xie, Journal of the American Chemical Society 127, 7480 (2005)). Consequently, the annealed core/shell quantum dots 120 would show a reduced quantum yield compared to the unannealed dots. To avoid this situation, the ZnS shell thickness needs to be increased to such an extent whereby the core/shell quantum dot electron wavefunction no longer samples the shell's surface states. Using calculational techniques well known in the art (S. A. Ivanov et al., Journal of Physical Chemistry 108, 10625 (2004)), the thickness of the ZnS shell should preferably be at least five monolayers (ML) thick in order to negate the influence of the electron surface states. However, up to a 2 mL thick shell of ZnS can be directly grown on CdSe without the generation of defects due to the lattice mismatch between the two semiconductor lattices (D). V. Talapin et al., Journal of Physical Chemistry 108, 18826 (2004)). To avoid the lattice defects, an intermediate shell of ZnSe can be grown between the CdSe core and the ZnS outer shell. This approach was taken by Talapin et al. (D. V. Talapin et al., Journal of Physical Chemistry B 108, 18826 (2004)), where they were able to grow up to an 8 mL thick shell of ZnS on a CdSe core, with an optimum ZnSe shell thickness of 1.5 mL. More sophisticated approaches can also be taken to minimize the lattice mismatch difference. For instance, smoothly varying the semiconductor content of the intermediate shell from CdSe to ZnS over the distance of a number of monolayers (R. Xie et al., Journal of American Chemical Society 127, 7480 (2005)). In sum the thickness of the outer shell is made sufficiently thick so that neither free carrier samples the electronic surface states. Additionally, if necessary, intermediate shells of appropriate semiconductor content are added to the quantum dot in order to avoid the generation of defects associated with thick semiconductor shells 110.

As a result of surface plasmon effects (K. B. Kahen, Applied Physics Letter 78, 1649 (2001)), having metal layers adjacent to emitter layers results in a loss in emitter efficiency. Consequently, it is advantageous to space the emitters' layers from any metal contacts by sufficiently thick (at least 150 nm) charge transport layers (e.g. 14, 18) or conductive layers (e.g. 12, 20). Finally, not only do transport layers inject electron and holes into the emitter layer, but by proper choice of materials, they can prevent the leakage of the carriers back out of the emitter layer. For example, if the inorganic nanoparticles 140 were composed of $ZnS_{0.5}Se_{0.5}$ and the transport layers were composed of ZnS, then the electrons and holes would be confined to the emitter layer by the ZnS potential barrier. Suitable materials for the p-type transport layer include II-VI and III-V semiconductors. Typical I-VI semiconductors are ZnSe, ZnS, or ZnTe. Only ZnTe is naturally p-type, while ZnSe and ZnS are n-type. To get sufficiently high p-type conductivity, additional p-type dopants should be added to all three materials. For the case of II-VI p-type transport layers, possible candidate dopants are lithium and nitrogen. For example, it has been shown in the literature that $Li_3N$ can be diffused into ZnSe at ~350° C. to create p-type ZnSe, with resistivities as low as 0.4 ohm-cm (S. W. Lim, Applied Physics Letter 65, 2437 (1994)).

Suitable materials for n-type transport layers include II-VI and III-V semiconductors. Typical II-VI semiconductors are ZnSe or ZnS. As for p-type transport layers, to get sufficiently high n-type conductivity, additional n-type dopants should be added to the semiconductors. For the case of II-VI n-type transport layers, possible candidate dopants are the Type III dopants of Al, In, or Ga. As is well known in the art, these dopants can be added to the layer either by ion implantation (followed by an anneal) or by a diffusion process (P. J. George et al., Applied Physics Letter 66, 3624 [1995]). A more preferred route is to add the dopant in-situ during the chemical synthesis of the nanoparticle. Taking the example of ZnSe particles formed in a hexadecylamine (HDA)/TOPO coordinating solvent (M. A. Hines et al., Journal of Physical Chemistry B102, 3655 [1998]), the Zn source is diethylzinc in hexane and the Se source is Se powder dissolved in TOP (forming TOPSe). If the ZnSe were to be doped with Al, then a corresponding percentage (a few percent relative to the diethylzinc concentration) of trimethylaluminum in hexane would be added to a syringe containing TOP, TOPSe, and diethylzinc. In-situ doping processes, like these, have been successfully demonstrated when growing thin films by a chemical bath deposition process (J. Lee et al., Thin Solid Films 431-432, 344 [2003]).

Inorganic LED devices of this invention can employ various well-known optical effects in combination with optical materials deposited in one or more wells in order to enhance its properties if desired. This includes optimizing layer thicknesses to yield maximum light transmission, providing dielectric mirror structures, replacing reflective electrodes with light-absorbing electrodes, providing anti glare or anti-reflection coatings over the display, providing a polarizing medium over the display, or providing colored, neutral density, or color conversion filters in functional relationship with the light emitting areas of the display. Filters, polarizers, and anti-glare or anti-reflection coatings can also be provided over a cover or as part of a cover.

The inorganic LED device can have a microcavity structure. In one useful example, one of the metallic electrodes is essentially opaque and reflective; the other one is reflective and semitransparent. The reflective electrode is preferably selected from Au, Ag, Mg, Ca, or alloys thereof. Because of the presence of the two reflecting metal electrodes, the device has a microcavity structure. The strong optical interference in this structure results in a resonance condition. Emission near the resonance wavelength is enhanced and emission away from the resonance wavelength is depressed. The optical path length can be tuned by selecting the thickness of the layers or by placing a transparent optical spacer between the electrodes. For example, an inorganic LED device of this invention can have an ITO spacer layer placed between a reflective anode and the EL media, with a semitransparent cathode over the EL media.

This invention can also be applied to inverted inorganic LED structures wherein the cathode is on substrate and the anode is on the top of the device.

The invention has been described in detail with particular reference to certain preferred embodiments thereof, but it will be understood that variations and modifications can be effected within the spirit and scope of the invention.

PARTS LIST

10 substrate
12 patterned electrode
13 insulator
14 charge-control layer
16 light-emitting layer
17 pixel
17R red light-emitting element
17G green light-emitting element
17B blue light-emitting element
18 charge-control layer
20 unpatterned, common electrode
22 patterned conductive layer
24 optical material
26 bus
28 insulator
30 raised area
31 well
31R red well
31G green well
31B blue well
32 planarization layer
40 inkjet device
100 light-emitting core
110 semiconductor shell
115 organic ligands
120 light-emitting core/shell nano-particle
120R red light-emitting particle
120G green light-emitting particle
120B blue light-emitting particle
130 agglomeration
140 inorganic nanoparticles
200 provide substrate step
205 form patterned electrodes step
210 form raised areas step
215 form patterned conductive layer step
220 deposit dispersion step
225 dry dispersion step
230 anneal dispersion step
235 form unpatterned common electrode step
300 manufacture light-emitting particles step
305 manufacture non-conductive particles step
310 form dispersion step

The invention claimed is:

1. A method of making an inorganic light-emitting diode display having a plurality of light-emitting elements comprising:

(a) providing a substrate;
(b) forming a plurality of patterned electrodes over the substrate;
(c) forming a raised area around each patterned electrode to provide a well;
(d) depositing a dispersion containing inorganic, light-emissive core/shell nano-particles into each well;
(e) drying the dispersion to form a light-emitting layer comprising the inorganic, light-emissive core/shell nano-particles;
(f) forming an unpatterned, common electrode over the light-emitting layer;
(g) wherein the light-emitting layer emits light by the recombination of holes and electrons supplied by the electrodes; and
(h) forming a patterned conductive layer disposed over the unpatterned, common conductive layer.

2. The method of claim 1, further comprising providing a plurality of conductive or semi-conductive nano-particles in the dispersion.

3. The method according to claim 1, further comprising annealing the light-emitting layer after drying the dispersion.

4. The method according to claim 1, further comprising employing inkjet, spray, curtain, or hopper coating to deposit optical material into one or more wells.

5. The method according to claim 4 wherein the optical material is a color filter material, a light-scattering material, or a liquid material that self-aligns to form a lenslet.

6. The method according to claim 1 further including forming a patterned conductive layer in electrical contact with the common, unpatterned electrode.

7. The method according to claim 6 wherein the patterned conductive layer is substantially in contact with the common, unpatterned electrode in the raised areas and substantially free from contact with the common, unpatterned electrode in the areas within the well.

8. The method according to claim 6 wherein the patterned conductive layer forms the raised areas.

9. The method according to claim 1 wherein the patterned conductive layer is located at least partially on the raised areas.

10. The method according to claim 1 wherein the dispersion containing inorganic, light-emissive core/shell nanoparticles is deposited into the wells by employing ink jet, spray deposition, curtain, or hopper coating.

11. The method according to claim 1 further comprising providing a plurality of dispersions, each dispersion containing different inorganic, light-emissive particles that emit different colors of light, and the different dispersions being deposited into different wells.

12. The method according to claim 1, wherein dispersion does not fill the well and the raised areas serve as barriers to prevent the diffusion of dispersions from one well to another.

13. The method according to claim 1, wherein the wells are greater than or equal to 1 micron deep.

14. The method according to claim 1, wherein the wells are greater than or equal to 3 microns deep.

* * * * *